United States Patent [19]

Kurokawa

[11] 4,000,728

[45] Jan. 4, 1977

[54] FUEL INJECTION GOVERNOR

[75] Inventor: Fuminori Kurokawa, Higashimatsuyama, Japan

[73] Assignee: Diesel Kiki Co., Ltd., Tokyo, Japan

[22] Filed: Aug. 14, 1975

[21] Appl. No.: 604,741

[30] Foreign Application Priority Data

Aug. 15, 1974 Japan ..... 49-93547

[52] U.S. Cl. ..... 123/140 R

[51] Int. Cl.[2] ..... F02D 1/04

[58] Field of Search ..... 123/140 R

[56] References Cited

UNITED STATES PATENTS

| | | | |
|---|---|---|---|
| 3,659,570 | 5/1972 | Yoshino | 123/140 R |
| 3,672,343 | 6/1972 | Biechl | 123/140 R |
| 3,759,236 | 9/1973 | Staudt | 123/140 R |
| 3,791,362 | 2/1974 | Nakamura | 123/140 R |
| 3,895,619 | 4/1975 | Potter | 123/140 R |

*Primary Examiner*—Harold W. Weakley
*Attorney, Agent, or Firm*—Frank J. Jordan

[57] ABSTRACT

A centrifugal governor has flyweights connected to move a fuel control rod through a floating lever which comprises first and second links, both of which are pivotally connected to a pin movable by the flyweights. The first link is connected to the fuel control rod and the second link is connected to a load control member. A third link which is also pivotal about the pin is biased toward engagement with a stopper. The third link has an engaging pin fixed thereto which is urged to engage with the first link. The second link carries an engaging member with which the first link is engagable. At low flyweight rotational speed under full load conditions the third link is biased into engagement with the stopper and the engaging pin moves the first link and thereby the fuel control rod toward a minimum fuel position. As the flyweight rotational speed increases the first link and fuel control rod are moved to increase the fuel supply until the first link engages with the engaging member. Afterwards the first and second links pivot in a unitary manner about the point of connection of the second link and the load control member to move the fuel control rod to decrease the fuel supply. The point of engagement of the first link with the engaging member is dependent on the position of the load control member.

13 Claims, 5 Drawing Figures

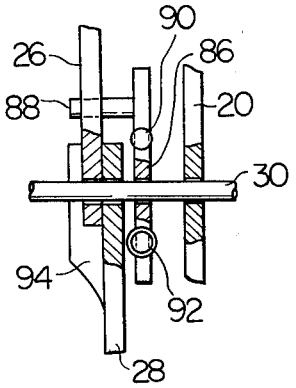
Fig. 3
Fig. 4
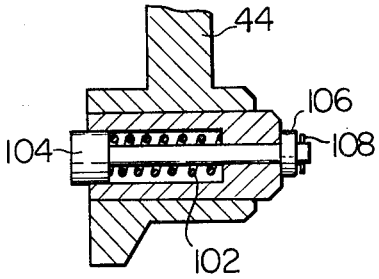
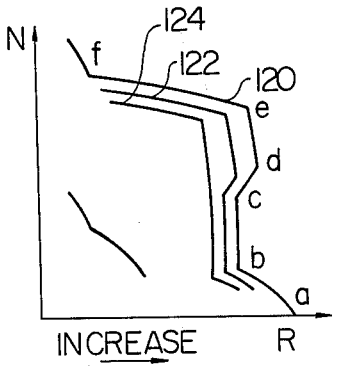
Fig. 5

FUEL INJECTION GOVERNOR

The present invention relates to a fuel injection pump governor especially suited for a compression ignition (Diesel) engine comprising a supercharger such as an exhaust turbocharger.

In a compression ignition engine employing an induction air supercharger, it is desirable to increase and thereafter decrease the fuel supply in the engine speed range between idling and high speed. A known governor which provides this function is disclosed in U.S. Pat. No. 3,672,343 to Biechl et al. More specifically, Biechl discloses maximum speed governor with the maximum speed being variable. It is, however, further desirable to control the increase and decrease of the fuel supply in dependence on the engine load, a feature which is not taught in the above patent. The load control function may be carried out by means of a manual load control member.

It is therefore an object of the present invention to provide a governor for a fuel injection pump of a compression ignition engine which provides optimum control of the engine fuel supply in response to engine speed and load.

It is another object of the present invention to provide a governor comprising a floating lever connecting flyweights and a load control member to a fuel control rod, the floating lever being composed of two links pivotal about a common pin which is moved by the flyweights, a third link pivotal about the pin and an engaging member fixed to one of the links performing the regulation of the fuel supply in the speed range between idling and high speed.

It is another object of the present invention to provide a governor which is accurate in operation, simple in construction and being readily produced on a commercial basis using inexpensive manufacturing techniques.

The above and other objects, features and advantages of the present invention will become apparent from the following detailed description taken with the accompanying drawings, in which:

FIG. 3 is an enlarged end view of the floating lever and guide lever assembly;

FIG. 4 is an enlarged sectional view of a tension lever and idling spring assembly shown in FIG. 1; and FIG. 5 is a diagram illustrating the operation of the governor.

Figure 1:
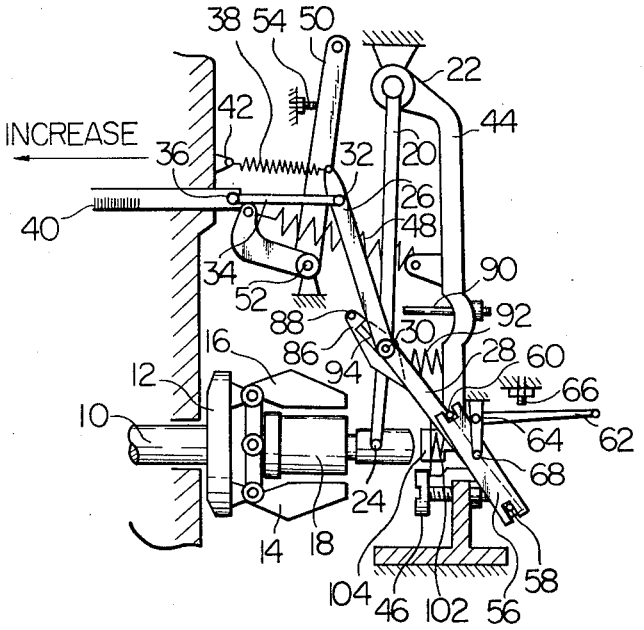
FIG. 1 is a schematic diagram of a governor embodying the present invention.

Referring now to FIG. 1 of the drawings, the governor comprises a shaft 10 connected for rotation by a compression ignition engine (not shown) at a speed proportional to the engine speed. A flyweight plate 12 is connected for rotation with the shaft 10 and carries flyweights 14 and 16 in a conventional pivotal mannner. Rotation of the shaft 10 and flyweights 14 and 16 causes the flyweights 14 and 16 to be flung outward by centrifugal force and move a shifter 18 rightward as viewed in FIG. 1. A guide lever 20 is pivotally connected at one end to a fixed pivot 22 and at the other end to the shifter 18 by a pin 24. A floating lever (no numeral) is composed of two links 26 and 28 which are pivotally connected to a movable pin 30 which is connected to an intermediate point of the guide lever 20.

The link 26 is pivotally connected to a connecting link 34 by a pin 32, the other end of the connecting link 34 being connected to a fuel control rod 40 by a pin 36. A tension starting spring 38 is connected between the end of the link 26 and a fixed point 42. The fuel control rod 40 is movable leftward towards a maximum fuel position or in an increasing fuel direction and rightward to decrease the fuel injection volume.

A tension arm 44 is pivotal about the pivot 22 and urged to abut against a stopper 46 in the clockwise direction by a speed control tension spring 48. The spring 48 is connected between the tension arm 44 and a bellcrank speed control lever 50 which is pivotal about a pivot 52 and engageable with a maximum speed stopper 54.

A connecting lever 56 is pivotally connected at one end to the end of the link 28 by a pin 58 and at the end to the tension arm 44 by a pin 60. A load control bellcrank lever 62 is pivotal about an intermediate pin 64 and engageable with a maximum load stopper 66. An end of the lever 62 is connected to an intermediate point of the lever 56 by a pin 68. The load control lever 62 may be actuated manually.

Figure 2:
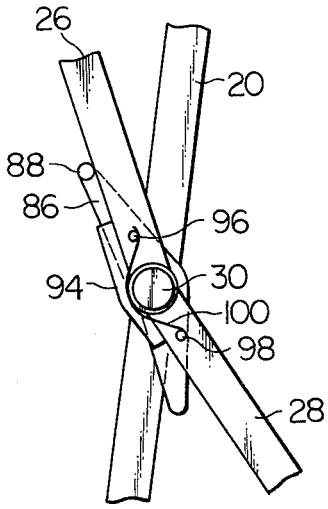
FIG. 2 is an enlarged side view of a floating lever and guide lever assembly shown in FIG. 1.

A novel feature of the present invention will now be described with reference also being made to FIGS. 2 and 3. A third link 86 is pivotal about the pin 30 and carries a pin 88 at its upper end which is engageable with the first link 26. A compression spring 92 connected between the tension arm 44 and the lower end of the link 86 urges the link 86 clockwise to engage with a stopper 90 fixed to the tension arm 44 at a point intermediate between the pins 30 and 88. An engaging member 94 is integral with the second link 28 and is engageable with the first link 26.

A pin 96 is fixed to the first link 26 and a pin 98 is fixed to the second link 28. A spring 100 wound around the pin 30 and connected to the pins 96 and 98 urges the first link 26 counterclockwise to engage with the engaging member 94 of the second link 28.

Referring also to FIG. 4, the governor also comprises an idling spring 102 carried by the tension arm 44. The idling spring 102 is a compression spring fitted in a bore (no numeral) in the tension arm 44 and urges an engaging stop or pin 104 leftwards (in FIGS. 1 and 4). A washer 106 and cotter pin 108 passed through the right end portion of the pin 104 limit the leftward movement of the pin 104.

The operation of the governor will now be described with reference to the drawings.

1. Starting

In manual two speed operation the speed control lever 50 is rotated to a position corresponding to the desired maximum speed. This determines the force which must be exerted on the tension arm 44 by the flyweights 14 and 16 through the shifter 18 to move the same against the force of the governor spring 48. The load control lever 62 is rotated to the maximum load position against the stopper 66. Specifically, the flyweights 14 and 16 are retracted and the shifter 18 is in its leftmost position with a space maintained between the right end thereof and the left end of the pin 104. The second link 28 is rotated counterclockwise to an extent such that the engaging member 94 is out of engagement with the first link 26. The first and second links 26 and 28 respectively are therefore disconnected from each other.

In the stopped condition, the starting spring 38 pulls the first link 26 and fuel control rod 40 to the maximum leftward position corresponding to maximum fuel injection. The spring 92 is in its free state and the third link 86 is positioned so that the pin 88 just touches the first lever 26 and the bottom end of the third link 86 just touches the left end of the spring 92. As the engine is ignited, the flyweights 14 and 16 are flung outward moving the shifter 18 rightward and causing the guide lever 20 to pivot counterclockwise about the pivot 22. This causes the pin 30 to be shifted rightward. In practice, the spring 92 is selected to be stronger than the starting spring 38 and the idling spring 102. For this reason, the spring will 92 will not yield upon rightward movement of the third link 86 causing the third link 86 to rotate clockwise about the pin 30. Engagement of the pin 88 with the first link 26 will cause the first link 26 to pivot clockwise about the pin 30 along with the third link 86 against the force of the starting spring 38. This will move the fuel control rod 40 rightward to decrease the fuel injection volume as the engine speed increases.

As soon as the engine is started, the load lever 62 is rotated to a maximum clockwise position corresponding to minimum engine load. This causes the lever 56 to pivot clockwise about the pin 60 causing the second link 28 to pivot clockwise about the pin 30 to a point at which the engaging member 94 engages with the first link 26. Further rotation of the lever 62 clockwise will cause the second and first links 28 and 26 respectively to pivot clockwise about the pin 30 in a unitary manner thereby moving the fuel control rod 40 rightward to an idling position.

2. Idling

With the first and second links 26 and 28 respectively locked together by means of the engaging member 94, further rightward movement of the shifter 18 will cause the shifter 18 to engage with the pin 104.

Further increase in engine speed will cause the movement of the shifter 18 to be opposed by both the starting spring 38 and the idling spring 102. The idling spring 102 is preset to yield when a predetermined engine idling speed is exceeded. When this occurs, the shifter 18 and pin 30 move rightward against the force of the starting and idling springs 38 and 102 thus causing the first and second links 26 and 28 to rotate clockwise about the pin 58 and move the fuel control rod 40 rightward to reduce the fuel injection volume and slow the engine down to the predetermined idling speed.

3. Intermediate speed

The intermediate speed operation of the governor will be described with reference to FIG. 5, in which the ordinate axis represents the engine speed N and the abscissa axis represents the position R of the fuel control rod 40 and thereby the amount of fuel injected into the engine. Rightward displacement along the abscissa axis of FIG. 5 corresponds to leftward movement of the fuel control rod 40 as viewed in FIG. 1.

The starting operation described above is represented by a portion *a–b* of a full load curve 120 which is obtained when the load control lever 62 is in the maximum load position against the stopper 66, in which the fuel control rod 40 is moved rightward against the starting spring 38. The speed is reached at a point c of the curve 120. The point c is that at which the shifter 18 engages with the pin 104. Also at the point c the third link 86 just touches the stopper 90.

The governor will remain in this state until the engine speed reaches the speed at the point *c.* The guide lever 20 will pivot counterclockwise about the pivot 22 and the pin 30 carried thereby will move rightward. The point of engagement of the third link 86 with the stopper 90 in this case will serve as a pivot point for the third link 86, which will be forced to rotate counterclockwise thereabout against the force of the spring 92. This will cause the pin 88 to move leftward. Since the first link 26 is biased into engagement with the pin 88 by the starting spring 38 and the spring 100, the first link 26 will pivot counterclockwise about the pin 30 thereby moving the control rod 40 leftward to increase the fuel injection volume. As shown in FIG. 5 by a portion *c–d* of the curve 120, the fuel injection volume increases in this engine speed range as the engine speed increases to satisfy the requirements of a supercharged Diesel engine. This action continues until the engine speed has risen as indicated by the point *d* of the curve 120, at which the engaging member 94 of the second link 28 engages with the first link 26. It will be noted that rightward movement of the pin 30 with the third link 86 in engagement with the stopper 90 causes the first link 26 to pivot counterclockwise about the pin 30 and the second link 28 to pivot clockwise about the pin 58. The engaging member 94 and the first link 26 thereby approach each other. This action continues until the engine speed has risen as indicated by the point e of the curve 120, at which the idling spring 102 is compressed to the extent that the shifter 18 abuts against the tension lever 44.

4. High speed

With the shifter 18 engaged with the tension lever 44, further rightward movement thereof will be opposed by the combined forces of the starting spring 38, idling spring 102 and governor spring 48, thereby causing the fuel injection to decrease as shown by a curve portion *e–f.* The engine speed will therefore be maintained at the maximum value corresponding to the point *e.*

5. Variable high speed

As described above, rotation of the speed control lever 50 will vary the effective force of the spring 48 on the tension lever 44 thereby varying the maximum speed of the engine in a conventional and well known manner.

6. Manual load control

The load control lever 62 may be manually rotated to limit the maximum fuel injection volume to a value producing smokeless combustion, as shown by curves 122 and 124 which represent progressive clockwise rotation of the load control lever 62 away from the stopper 66.

The basic principle of load control by the present governor is that the fuel injection is controlled by the flyweights 14 and 16 as a function of engine speed by means of the third link 86 and the maximum fuel injection volume determined by the engine load is controlled by the load control lever 62 by means of the second link 28 with the load control function over-riding the speed control function when required.

Under full load conditions when the engine is producing maximum power and the supercharged induction air pressure is sufficiently high to allow a large amount of fuel to be burned smokelessly, the fuel injection volume may be controlled solely as a function of engine speed. The flyweights 14 and 16 control the position of the pin 88 independently of the load control lever 62, and the first link 26 which controls the position of the control rod 40 is urged to abut with pin 88 thereby determining the fuel injection volume. At low engine loads with low supercharged induction air pressure the engine cannot burn as much fuel smokelessly as determined by the engine speed alone. In this case, the load control lever 62 is rotated clockwise thereby moving the engaging member 94 closer to the first link 26. When the engaging member 94 engages with the first link 26 and rotates the same clockwise to reduce the fuel injection volume, it will be seen that the fuel injection volume is controlled by the load control member 62 since the starting spring 38 and spring 100 will cause the first link 26 to engage with the engaging member 94 at a more clockwise (lower fuel injection volume) position than that at which the first link 26 would engage with the pin 88.

Many modifications to the exemplary embodiment shown and described will be possible to those skilled in the art after receiving the teachings of the present disclosure.

What is claimed is:

1. A fuel injection pump governor, comprising:

a fuel control member;

a movable pin;

flyweights connected to move the movable pin in dependence on a flyweight rotational speed;

a first link pivotal about the movable pin, the first link being pivotally connected to the fuel control member at a point spaced from the movable pin;

a second link pivotal about the movable pin;

a movable load control means pivotally connected to the second link at a point spaced from the movable pin;

a third link pivotal about the movable pin;

an engaging pin fixed to the third link and being engageable with the first link;

a stopper, the third link being engageable with the stopper at a point between the engaging pin and the movable pin;

biasing means urging the third link so that the engaging pin is urged to engage with the first link and the third link is urged to engage with the stopper; and means operative to connect the first link to the second link for unitary pivotal movement about the point of pivotal connection between the second link and the load control means at a position of the movable pin which is dependent on the position of the load control means.

2. A governor according to claim 1, in which the means comprises an engaging member integral with the second link and engageable with the first link at said position.

3. A governor according to claim 2, in which the means further comprises a spring urging the first and second links so that the engaging member and first link are urged toward engagement.

4. A governor according to claim 1, further comprising a governor spring arranged to resist movement of the flyweights and thereby the movable pin caused by centrifugal force of the flyweights.

5. A governor according to claim 4, further comprising a tension arm pivotal at one end about a fixed point and engageable with the flyweights, the governor spring being biasingly connected to the tension arm.

6. A governor according to claim 5, further comprising a speed control member, the governor spring being connected at one end to the speed control member and at the other end to the tension arm.

7. A governor according to claim 1, further comprising a starting spring urging the fuel control member toward a maximum fuel position.

8. A governor according to claim 5, in which the stopper is fixed to the tension arm.

9. A governor according to claim 5, further comprising:

a tension arm stopper with which the tension arm is engageable, the flyweights being engageable with the tension arm and thereby the governor spring only when the flyweight rotational speed is above a predetermined value.

10. A governor according to claim 9, further comprising an idling spring, the flyweights being engageable with the idling spring before engaging with the tension arm.

11. A governor according to claim 10, in which the idling spring is mounted on the tension arm.

12. A governor according to claim 1, further comprising a guide lever pivotally connected at one end to a fixed point and at the other end to the flyweights, the movable pin being connected to the guide lever at an intermediate point thereof.

13. A governor according to claim 5, in which the load control means comprises:

a connecting lever pivotally connected at one end to the second link and at the other end to the tension lever; and a load control lever pivotal about at intermediate fixed point and pivotally connected at one end to the connecting lever at an intermediate point thereof.

* * * * *